United States Patent [19]

Holopainen

[11] 4,403,906

[45] Sep. 13, 1983

[54] MATERIAL HANDLING APPARATUS

[76] Inventor: Vaino J. Holopainen, P.O. Box 806, Center Harbor, N.H. 03226

[21] Appl. No.: 320,462

[22] Filed: Nov. 12, 1981

[51] Int. Cl.[3] ..... B66C 23/54

[52] U.S. Cl. ..... 414/724; 37/DIG. 3; 414/912

[58] Field of Search ..... 414/749, 622, 718, 724, 414/704, 563; 37/117.5, DIG. 3, DIG. 12; 212/255, 268

[56] References Cited

U.S. PATENT DOCUMENTS

| | | | |
|---|---|---|---|
| 2,717,704 | 9/1955 | Pilch | 214/147 |
| 2,768,760 | 10/1956 | Pilch | 414/698 X |
| 3,042,235 | 7/1962 | Stewart | 214/145 |
| 3,057,496 | 10/1962 | Garske | 214/140 |
| 3,061,123 | 10/1962 | Rogers | 214/145 |
| 3,067,888 | 12/1962 | Reynolds | 214/140 |
| 3,148,787 | 9/1964 | Clark et al. | 214/147 |
| 3,273,729 | 9/1966 | Holopainen | 214/138 |
| 3,451,575 | 6/1969 | Petro, Jr. | 214/767 |
| 4,155,473 | 4/1979 | Holopainen | 414/704 |
| 4,187,049 | 2/1980 | Jones | 414/704 |
| 4,200,423 | 4/1980 | Sornsin | 414/724 |
| 4,264,265 | 4/1981 | Stoychoff | 414/718 |

*Primary Examiner*—Robert J. Spar
*Assistant Examiner*—Donald W. Underwood
*Attorney, Agent, or Firm*—Blodgett & Blodgett

[57] ABSTRACT

Apparatus for use on a front-end loader bucket including a telescopically-extendable clamp arm operating in conjunction with a solid link.

7 Claims, 7 Drawing Figures

MATERIAL HANDLING APPARATUS

BACKGROUND OF THE INVENTION

In the operation of a contracting business there are many instances where a front-end loader is useful in lifting and carrying large objects such as stones, bundles of brush, logs, and the like. For that purpose, a front-end loader with a bucket has sufficient strength to handle such large heavy objects, but, because they are so awkward, it is difficult to retain them on the bucket. My U.S. Pat. No. 4,155,473 which issued on May 22, 1979 discloses a hydraulically-actuated clamp arm operating with the bucket in handling awkward objects. The mechanism shown in that patent has the advantage that it can be stored along the top edge of the bucket when not in use. However, there has been a tendency recently to construct the buckets of front-end loaders so that they have increased height without a commensurate increase in width. This is because it has become desirable to make front-end loaders larger and stronger and, therefore, capable of carrying larger amounts of material in the bucket. However, the width of the bucket is limited by the ability to transport the loader over highways where there are certain legal limits to the width of a vehicle. For that reason, the only direction that increase in capacity of buckets can take is in the vertical direction, i.e., the distance between the bottom horizontal edge and the top horizontal edge. When one attempts to use the device shown in my above-mentioned patent on such narrow but high buckets, that problem arises that, if the clamp arm is made long enough to reach from the top edge to the bottom edge of the bucket, it extends outwardly of the bucket and presents a dangerous situation if one attempts to store it along the top edge of the bucket. In addition, it is wider than the mentioned legal vehicle width limits. Furthermore, if the clamp arm extends beyond the side of the bucket, it is likely to engage trees, buildings, boulders, etc. and create the possibility of severe damage to the arm and its associated parts. It would be understood that only half of the width of the bucket is available for storing the arm, so that the problem described above arises when the height of the bucket is greater than one-half of the width. These and other difficulties experienced with the prior art devices have been obviated in a novel manner by the present invention.

It is, therefore, an outstanding object of the invention to provide material handling apparatus for use on a front-end loader bucket, including a clamp arm which is retractable for storage but is extensible for use.

Another object of this invention is the provision of clamp arm for use on a bucket where the height of the bucket is greater than one-half of its width.

A further object of the present invention is the provision of an extensible clamp arm for use on a bucket, wherein the hydraulic actuator is not exposed to dirt and other deteriorating effects during operation.

It is another object of the instant invention to provide a clamp arm for use on material handling apparatus, which arm is simple and rugged in construction, which can be inexpensively manufactured from readily obtainable materials, and which is capable of a long life of useful service with a minimum of maintenance.

A still further object of the invention is the provision of an extensible clamp arm with no delicate external parts.

SUMMARY OF THE INVENTION

In general the invention consists of material handling apparatus for use with a pivoted bucket, wherein a clamp arm is mounted on the bucket for pivotal movement about one end, the clamp arm consisting of two telescoping parts. A hydraulic actuator is mounted within the arm to bring about telescoping action between the parts. A rigid link extends between an intermediate part of the arm and a point on the bucket spaced from the point where the arm is pivotally attached to the bucket.

More specifically, the intermediate point is located on the part of the arm which includes the outer end. A bracket is mounted on the upper edge of the bucket and includes two vertically-spaced pivot pins, the arm being connected to the upper pivot pin and the solid link being connected to the lower pivot pin.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
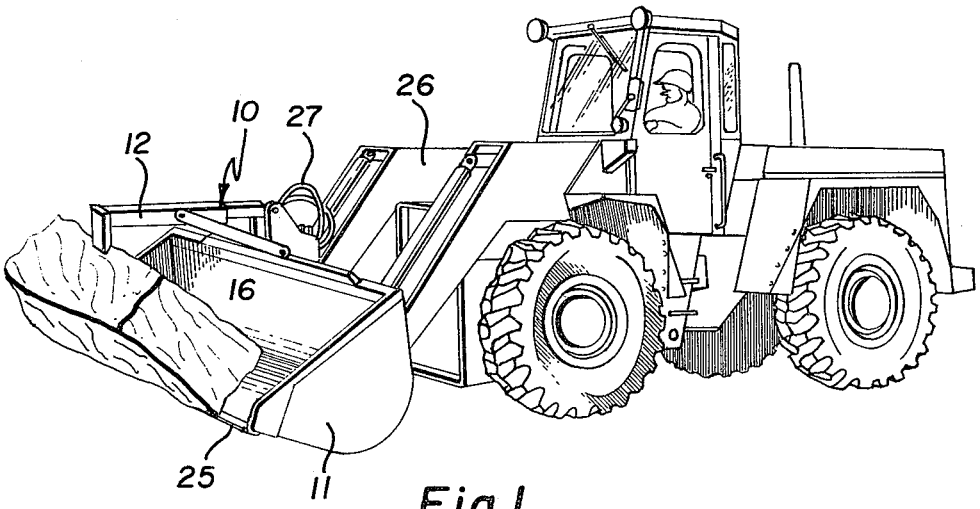
FIG. 1 is a perspective view of material handling apparatus embodying the principles of the present invention.

Referring first to FIG. 1, which best shows the general features of the invention, the material handling apparatus, indicated generally by the reference numeral 10, is shown in use on a bucket 11 which is attached to the lift arms 26 of a front end loader. The bucket is capable of rotation about a horizontal axis in the usual way. A clamp arm 12 is mounted on the bucket 11 for pivotal movement about a horizontal axis at its inner end. In FIG. 1 it can be seen that the front end loader is also provided with hydraulic system, including hoses 27 connected to the clamp arm 12. A rigid link 16 connects the clamp arm to the rest of the apparatus. It can also be seen that the bucket 11 is provided with a lower operating edge 25.

Referring next to FIGS. 2, 3, 4, and 5, it can be seen that the clamp arm 12 is provided with two telescoping parts, including an outer part 13 and an inner part 14. A hydraulic actuator 15 lies inside the clamp arm and brings about the aforementioned telescoping movement between the parts 13 and 14. The rigid link 16 connects an intermediate point on the arm 12 to a pivot point on the bucket spaced from the said one end of the arm, the intermediate point 17 being located on the outer part 13 of the arm. A bracket 18 is mounted on the upper edge of the bucket 11 and includes two vertically-spaced pivot pins 19 and 21. The upper pivot pin 19 is connected to the said one end of the arm 12, while the lower pivot pin 21 is connected to the rigid link 16. The bracket 18 consists of two portions 22 and 23, the portion 22 being fixed to the bucket and the other portion 22 being hingedly connected to the portion 23. The clamp arm 12 and the link 16 are connected to the portion 22 by the pivot pins 19 and 21, respectively.

Figure 2:
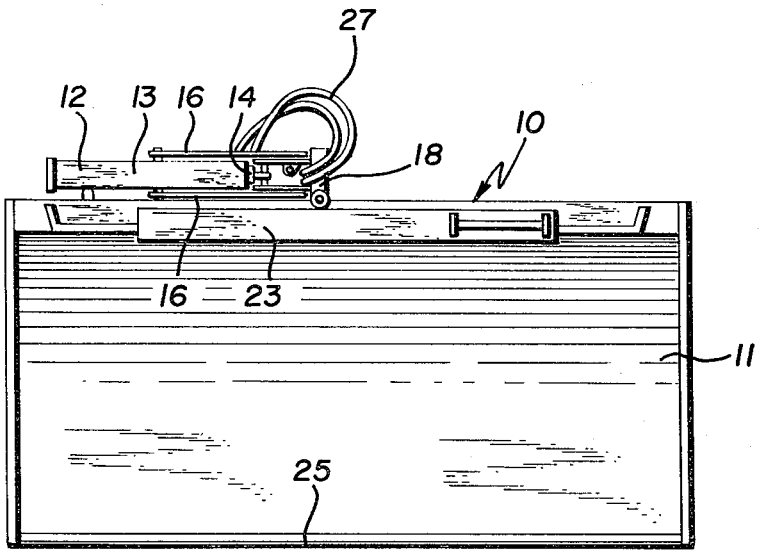
FIG. 2 is a front elevational view of the apparatus.

A second hydraulic actuator 24 joins the two portions 22 and 23 of the bucket 18 to bring about pivotal movement between them about the hinge axis which is at right angles to the operating edge 25 of the bucket. As has been pointed out above, the bucket 11 has a horizontal operating edge 25 and is mounted on the vehicle lift arms 26 for pivotal movement about an axis which is parallel to the operating edge. The clamp arm 12 is mounted on the portion 22 of the bracket 18 for swinging movement relative to the portion 23 of the bracket from a storage position (as shown in FIG. 2) where the clamp arm 12 extends along the outer surface of the bucket 11 parallel to the operating edge, to an operating position (shown in FIG. 4) in which the clamp arm 12 extends perpendicular to the operating edge 25.

The hydraulic hoses 27 are connected to the clamp arm 12 to energize the first hydraulic actuator 15 to cause the clamp arm 12 to move about its connection by the pivot pin 19 to the portion 22 of the bracket toward the operating edge 25 for clamping and away from the operating edge for unclamping. The pivotal connection of the said one portion 22 of the bracket to the other portion 23 is operative about an axis that is perpendicular to the operating edge 25. The hydraulic actuator 24 causes the clamp arm 12 to move from the storage position to the operating position when it brings about the said pivotal movement between the two portions 22 and 23 of the bracket.

Figure 6:
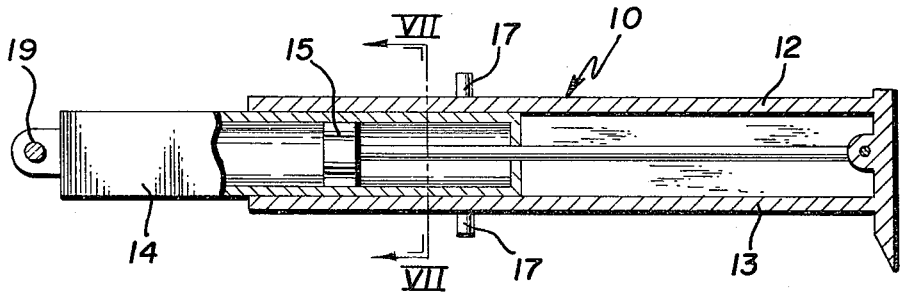
FIG. 6 is a vertical sectional view of the arm.
Figure 7:
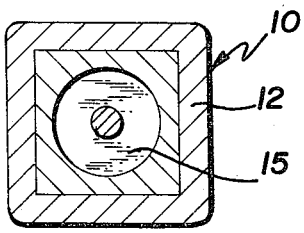
FIG. 7 is a vertical sectional view of the arm taken on the line VII—VII of FIG. 6.

As is evident in FIGS. 6 and 7, the parts 13 and 14 of the clamp arm 12 are made up of tubular elements having a generally square cross-section that telescope together. The part 14 is provided with a cylindrical bore in which slides the piston of the second hydraulic actuator 15. Extending from the piston is a piston rod which is connected to the outer portion of the part 12 of the clamp arm.

The operation and advantages of the present invention will now be readily understood in view of the above description.

When the vehicle is operated, the operator is able to manipulate the frame 26 and the bucket 11 to cause the bucket to rotate about its main axis parallel to the operating edge 25, and also to raise and lower the bucket. The clamp arm 12 is operated independently of these two movements through the hoses 27. The vehicle operating hydraulic fluid is available through the hoses 27 and is suitably valved to produce telescoping movement of the clamp arm 12 and also to provide for the operation of the hydraulic actuator 24.

Figure 3:
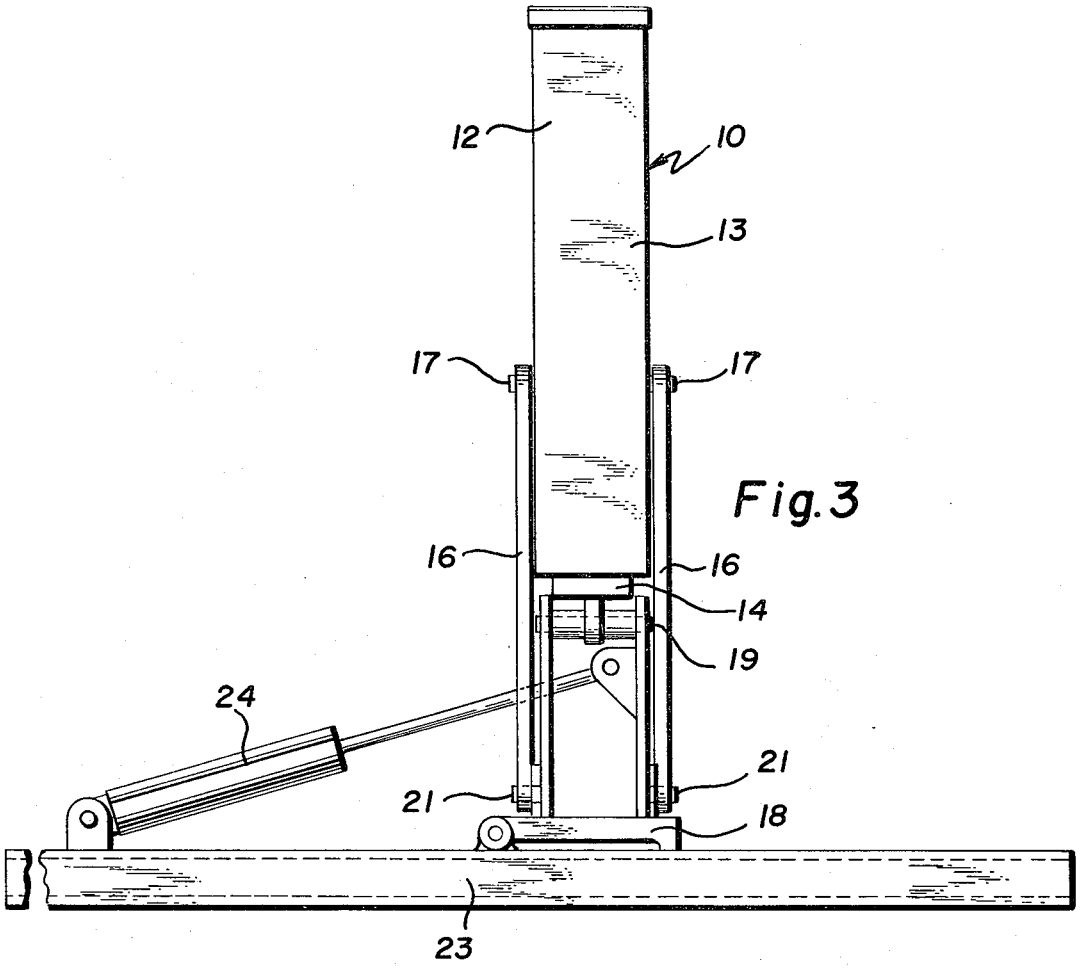
FIG. 3 is the front elevational view of the apparatus showing an arm in raised position.
Figure 4:
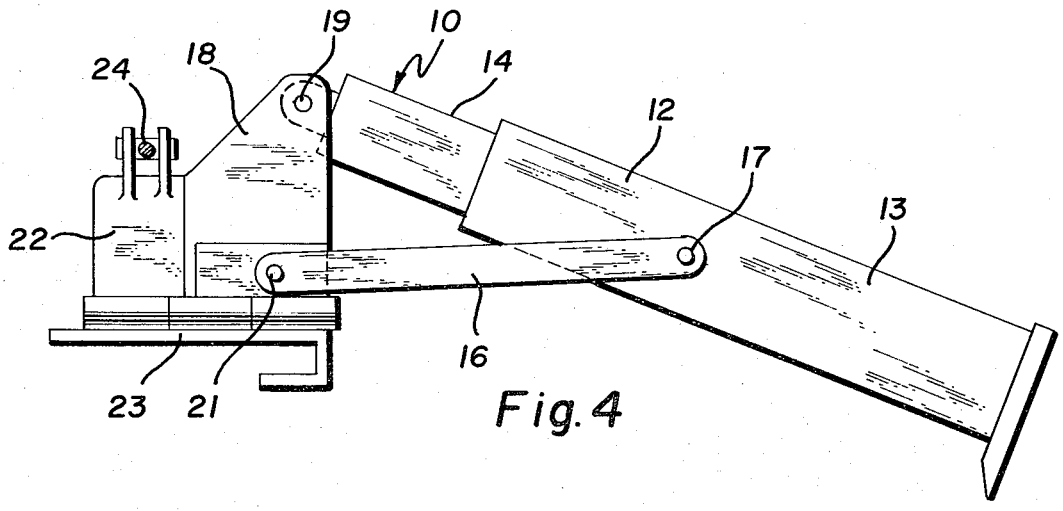
FIG. 4 is a side elevational view of the apparatus showing the arm in lowered position.
Figure 5:
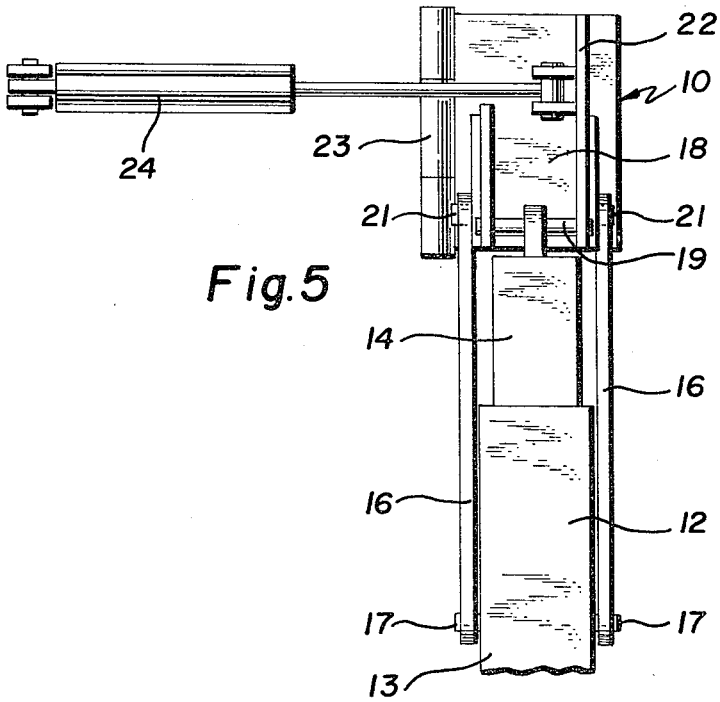
FIG. 5 is a plan view of the apparatus showing the arm in the lowered position.

Assuming that the clamp arm 12 is in the "storage" position, as shown in FIG. 2, it is only necessary to energize the actuator 24 to cause the portion 22 of the bracket 18 to rotate about its axis relative to the portion 23. This causes the clamp arm 12 to rise into the vertical position as shown in FIG. 3. Hydraulic fluid is locked in the cylinder when this position is reached so that the two parts 22 and 23 of the bracket 18 become rigidly connected and act as a solid bracket. It is then only necessary to introduce fluids suitably in front of and behind the piston of the acutator 15 to operate the clamp arm and move it downwardly as shown in FIGS. 4 and 5. This downward movement consists of an extension by telescopic movement between the parts 13 and 14 of the clamp arm. Since the link 16 is rigid, this causes the clamp arm to move downwardly and to provide a clamping force between its outer end and the operating edge 25 of the bucket 11. It is possible, then, by engaging an object (such as the granite block shown in FIG. 1), so that it can be clamped and raised by use of the conventional hydraulic actuator built into the front end loader. For this purpose, the object can be either transported or loaded onto another vehicle such as a truck to move it to another location.

It can be seen, then, that the present invention allows the clamp arm to operate as a long member in the clamping mode shown in FIG. 1, while still being capable of telescoping to a short length, so that it can lie in the manner shown in FIG. 2 along the upper edge of the bucket. It permits the bucket to be as deep as is necessary relative to its width. In addition, the clamp arm 12 is free of any delicate mechanisms and includes only the simple structure (particularly well known in FIG. 4) of two telescoping parts and a rigid link 16. Neither of these parts would be subject to any extraordinary wear or damage during use with rough materials. It is economical to build, since it uses standard square cross-section tubing. There is a degree of user appeal, because of the better appearance and the fewer complications. The rod of the hydraulic actuator 15 is, of course, protected against damage. Furthermore, because of the peculiar manner in which the clamp arm operates, there is a better arc of movement in gathering the material to be grasped toward the bucket.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Material handling apparatus for use on a pivoted bucket, comprising:
   (a) a bracket mounted on an upper edge of the bucket,
   (b) a clamp arm mounted on the bucket for pivotal movement about one end, the clamp arm consisting of two telescoping parts, one of said parts being pivotally connected at a first point to said bracket,
   (c) a first hydraulic actuator located in the arm to produce telescoping movement between the parts, and
   (d) a rigid non-extendable link pivotally connected at one end to the other of said parts and pivotally connected at its opposite end to the bracket at a second point which is spaced from said first point.

2. Material handling apparatus as recited in claim 1, wherein the bracket consists of two portions, one portion of which is fixed to the bucket and the other portion of which is pivotally connected to the said one portion and to which the clamp arm and the link are connected.

3. Material handling apparatus as recited in claim 2, wherein a second hydraulic actuator joins the two portions of the bracket to bring about pivoted movement between them.

4. Material handling apparatus as recited in claim 3, wherein the bucket has a horizontal operating edge and is mounted on a vehicle frame for pivotal movement about a first axis parallel to the operating edge, wherein the clamp arm is mounted on the said other portion of the bracket for swinging movement relative to the said one portion of the bracket from a storage position in which the clamp arm extends along the outer surface of the bracket parallel to said operating edge to an operating position in which the clamp arm extends perpendicular to said operating edge.

5. Material handling apparatus as recited in claim 4, wherein hydraulic hoses are connected to the clamp arm to energize the first hydraulic actuator to cause the clamp arm to move about its connection to the said other portion of the bracket toward said operating edge for clamping and away from said operating edge for unclamping.

6. Material handling apparatus as recited in claim 5, wherein the pivoted connection of the said one portion of the bracket to the other portion being operative about an axis that is perpendicular to the operating edge, and wherein the connection of the clamp arm to the said other portion of the bracket is operative about an axis that is parallel to the operating edge.

7. Material handling apparatus as recited in claim 6, wherein the second hydraulic actuator causes the clamp arm to move from storage position to operating position when it brings about the said pivoted movement between the two portions of the bracket.

* * * * *